US005291834A

United States Patent [19]

Quaas

[11] Patent Number: 5,291,834

[45] Date of Patent: Mar. 8, 1994

[54] RAIL FOR MAGNETIC LEVITATION VEHICLE

[75] Inventor: Hans-Rainer Quaas, Gröbenzell, Fed. Rep. of Germany

[73] Assignee: Magnetbahn GmbH, Starnberg, Fed. Rep. of Germany

[21] Appl. No.: 86,380

[22] PCT Filed: Sept. 20, 1990

[86] PCT. No.: PCT/EP90/01598
§ 371 Date: May 22, 1992
§ 102(e) Date: May 22, 1992

[87] PCT Pub. No.: WO91/04375
PCT Date: Apr. 4, 1991

Related U.S. Application Data

[63] Continuation of Ser. No. 689,267, May 22, 1991, abandoned.

[30] Foreign Application Priority Data

Sep. 23, 1989 [DE] Fed. Rep. of Germany ..... 3931794
Oct. 24, 1989 [DE] Fed. Rep. of Germany ..... 3935323

[51] Int. Cl.[5] ..... E01B 25/10

[52] U.S. Cl. ..... 104/281; 104/124; 104/245

[58] Field of Search ..... 104/281, 282, 283, 290, 104/292, 246, 245, 124

[56] References Cited

U.S. PATENT DOCUMENTS 4,064,808 12/1977 Nakamura et al. ..... 104/281
4,274,336 6/1981 Pater et al. ..... 104/124
4,516,505 5/1985 Heidelberg ..... 104/281
4,696,235 9/1987 Wagner ..... 104/128
4,776,282 10/1988 Ishikura et al. ..... 104/246
5,094,172 3/1992 Kummer ..... 104/282

FOREIGN PATENT DOCUMENTS 7602219 8/1977 France ..... 104/290
8803974 6/1988 PCT Int'l Appl. .

*Primary Examiner*—Mark T. Le
*Attorney, Agent, or Firm*—Spencer, Frank & Schneider

[57] ABSTRACT

In magnetic levitation vehicles, supporting and driving forces are generated by a long stator on the track and permanent magnets on the vehicle. The underside of a rail provides the attachment of the long stator; the rail further has two oppositely disposed horizontal running surfaces for pairs of spacer rollers on the vehicle and a vertical running surface for lateral guide rollers on the vehicle. For a particularly simple and inexpensive production of the rail it is proposed to make the one end section of the railhead of the rail the horizontal running surfaces and a lateral guide profile fastened to the underside of the railhead the vertical running surface.

15 Claims, 4 Drawing Sheets

RAIL FOR MAGNETIC LEVITATION VEHICLE

This application is a continuation of application Ser. No. 07/689,267, filed May 22, 1991, now abandoned.

BACKGROUND OF THE INVENTION

1. Field of the Invention

The invention relates generally to a rail employed for a rail system and in particular to a rail for a maglev commuter train system.

2. Description of the Related Art

Maglev commuter train systems employ primarily elevated tracks which are composed of individual prefabricated track elements. These track elements are configured as single field carriers or as multiple field carriers. The vehicles of this commuter train system travel over this track without the danger of derailment and are based on the following operational principle. Namely, the vehicle weight is dissipated substantially as a load distributed over the surface area through the rails to the supporting structure of the track by way of permanent magnets fastened to height adjustable magnet carrier strips on both longitudinal sides of a rectangular vehicle undercarriage frame. In order to stabilize the unstable state between magnets and rails and to avoid a complete interruption of the magnetic attraction forces while maintaining a minimum air gap, a residual load of the vehicle weight is transferred by way of guide and spacer rollers running on the rails. The distance, that is, the air gap between the surfaces of the permanent magnets of the vehicle undercarriage and the rails and the surfaces of the long stator fastened to the rail, is regulated as a function of the respective vehicle weight (static and dynamic loads). The vehicle is driven by the cooperation of the permanent magnets of the vehicle undercarriage with the traveling electrical field of the long stator on the track (linear motor drive).

As can be seen from the cross-sectional view of the track of a prior art commuter traffic system shown in FIG. 1, the track elements are composed of two mutually parallel track carriers 11 which are connected with one another by way of transverse connectors 12. The transverse connectors 12 are structurally arranged at such a depth that an upwardly open trough appears as the cross section of the track. On both sides of the track carriers, rails 13 are fastened in the longitudinal direction. Rails 13 form a functional component of the track and serve to support, guide and drive the magnetic levitation vehicles. As is further evident from FIG. 1, the track is configured as a completely welded structure in which a railhead 131 is welded at a right angle to the ends of each track carrier 11, with a specially developed and fastened supporting and guide angle rail 132 being welded to the end faces of the railhead. For reasons of its supporting and driving function, riding comfort and wear of the guide and spacer rollers, high tolerance demands must be placed on the supporting structure which is connected with high and expensive manufacturing efforts. For example, the railheads 131, particularly if the track curves, must be burnt with great accuracy out of steel plates. Additionally, the angle rails 132 are relatively thin and thus bendably soft so that their ends give way under the vehicle load which results in uncomfortable jolts and a reduced service life of the guide and spacer rollers.

SUMMARY OF THE INVENTION

In view of this, it is the object of the invention to create a rail of the above-mentioned type which, in spite of high tolerance requirements for the supporting structure, can be manufactured more easily and less expensively and which, although of a comparable weight, additionally exhibits fewer elastic deformations from the vehicle load, particularly in the region of the rail joints.

This is accomplished according to the invention by the provision of a rail for a magnetic levitation vehicle, comprising a railhead with an inner end section, a free end section, and an underside; a long stator fastened to the underside of the railhead for generating, in cooperation with permanent magnets in the vehicle, supporting and driving forces for the vehicle; and a lateral guide profile fastened to the underside of the railhead, wherein the free end section of the railhead presents oppositely disposed, horizontal running surfaces for pairs of spacer rollers on the vehicle and the lateral guide profile presents a vertical running surface for lateral guide rollers on the vehicle.

Advantageous features and modifications of the rail according to the invention will become evident from the discussion below.

The invention is based on the consideration that, with respect to economical industrial prefabrication of the complete rails including their railhead, lateral guide profile and long stator components, a track structure is provided which permits a change in manufacturing technology from the customary, relatively rough supporting structure to a precise structural unit. The invention does without complicated special angle rails which pose engineering problems and instead uses the railhead of the rail which is employed in any case and which is supplemented by a lateral guide profile fastened to the underside of the railhead to serve as the vertical travel rail. The long stator is fastened to the underside of the railhead preferably not by the conventional welded connection but with the aid of a screw connection. The screwable long stator offers considerable advantages for the operation of a commuter traffic system particularly for reasons of being more easily repaired and maintained. If the rail which according to the invention is configured as a functional unit, is damaged, it is not necessary to exchange the entire track element. If necessary, the encasing of the long stator, which is necessary in the conventional welded method of fastening the long stator in order to avoid crevice corrosion, may also be omitted. The sufficient thickness of the railhead employed as the rail permits the configuration of a simple, form-locking connection at the joints with the aid of slide pins that are introduced into the respective upper face of the adjoining railheads. In this way, a level and thus jolt-free transition can be ensured at the ends of the rails. The rails which are preferably fastened in the track carrier as deeply as possible result in greater rigidity of the track structure which, in turn, leads to a reduction of traveling and drive noises since it reduces vibrations. In addition, the structural configuration with the deep-set track profile brings considerable advantages for the realization of a simple, cost-effective switch which, for compatibility with existing commuter traffic systems may possibly be equipped with a passively driven center switch member (frog) which supports the vehicle by way of magnetic forces. This center switch member, composed of two structurally interconnected rails, is mounted around a pivot point or more precisely, a displacement point. The switch frog is set for the desired direction of travel by means of a conventional switch drive. The reduction in track height due to the low lying track profile leads to considerable savings of material particularly in track sections that are embedded in ballast in tunnels or on bridges.

With the aid of the rail according to the invention, functional, manufacturing and operational advantages can be realized over the obviously prior art maglev commuter train system, leading to a significant reduction in costs.

BRIEF DESCRIPTION OF THE DRAWINGS

The invention will now be described in greater detail with reference to embodiments thereof that are illustrated in the drawing figures. It is shown in.

DETAILED DESCRIPTION OF THE PREFERRED EMBODIMENTS

Figure 1:
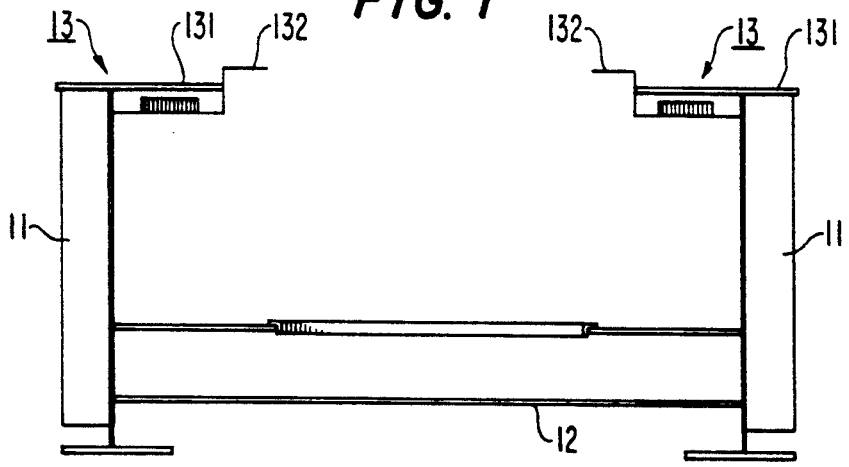
FIG. 1, a cross-sectional view of a track profile of a prior art maglev commuter train rail.
Figure 2:
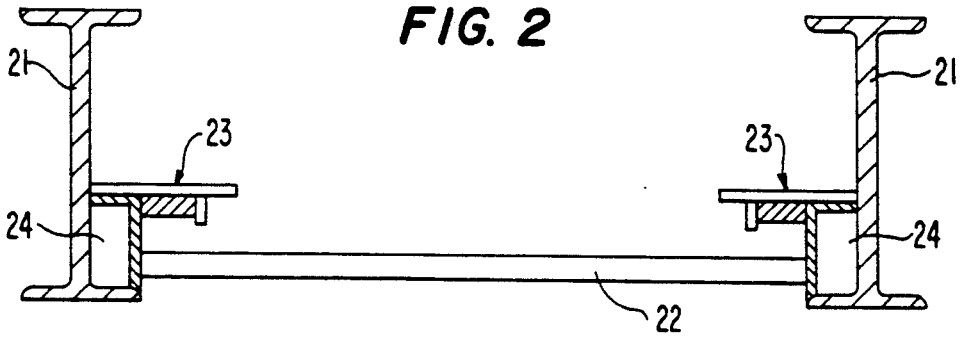
FIG. 2, a cross-sectional view of the low lying track profile of a maglev commuter train system.

As can be seen in FIG. 2, a track profile 20 includes two mutually parallel track carriers 21 in the form of a double-T profile whose lower, inwardly oriented base is reconfigured into a box profile 24. Each box profile serves as a support for a rail 23 according to the invention which is connected to the respective track carrier 21 or, more precisely, with its box-shaped profile 24.

Figure 3:
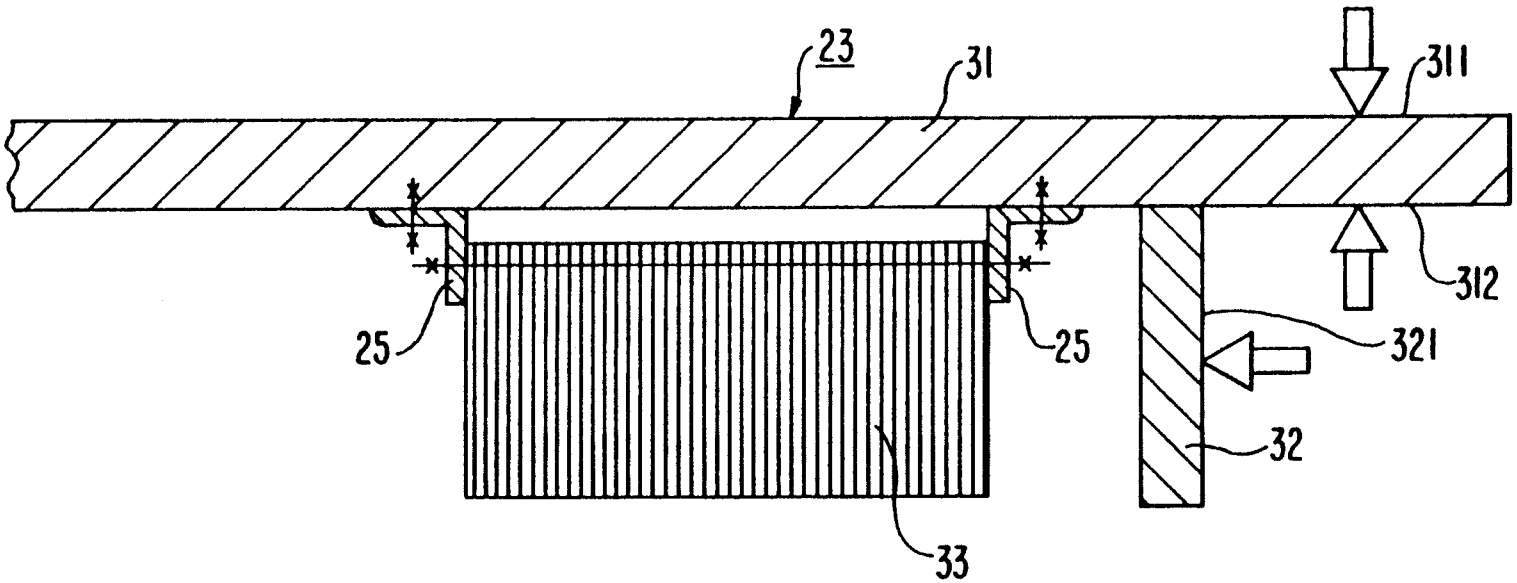
FIG. 3, a cross-sectional view of one of the two rails of the track profile according to the invention as shown in FIG. 2.

As can be seen in detail in FIG. 3, each rail 23 is composed of a railhead 31 having a free end on which an upper running surface 311 and a lower running surface 312 are formed projecting inwardly toward the track profile for the nonillustrated guide and spacer rollers of the undercarriage of the above-described magnetic levitation vehicle. A lateral guide profile 32 is fastened to the underside of railhead 31—offset relative to its free end—preferably at a right angle. The surface of this lateral guide profile forms the running surface 321 for the track guidance of the undercarriage and its vertical rollers within the maglev train track. Railhead 31 is composed of a rectangular steel profile having a thickness of at least 30 mm, a width of about 500 to 600 mm and a length which is adapted to the respective length of the individual supporting structure elements. Railhead 31 may be straight in its longitudinal extent or appropriately bent for horizontal curves. In transitional sections of the track where the track goes uphill or downhill, the railhead is also bent concavely or convexly about its transverse axis.

Figure 4:
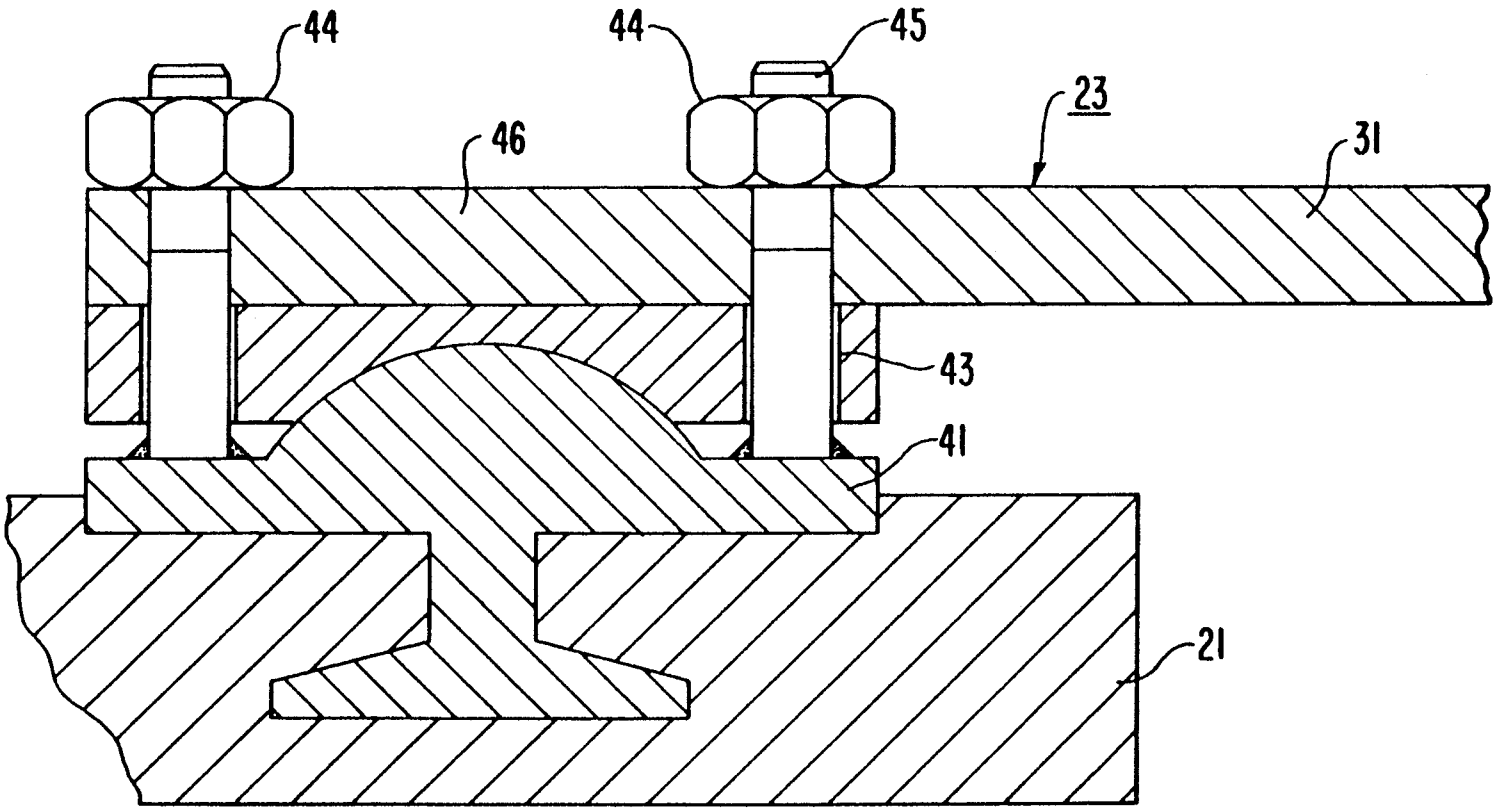
FIG. 4, a cross-sectional view of the fastening means of the rail according to FIG. 3 at the supporting structure of the track.

The railhead 31 is connected to longitudinal or track carriers 21 of the supporting structure and is effected by a weld connection or, as shown in FIG. 4, by a special screw connection. The height position of rail 23 is selected so that a minimum distance is maintained from transverse connectors 22 (FIG. 2) between longitudinal carriers 21.

Figure 2A:
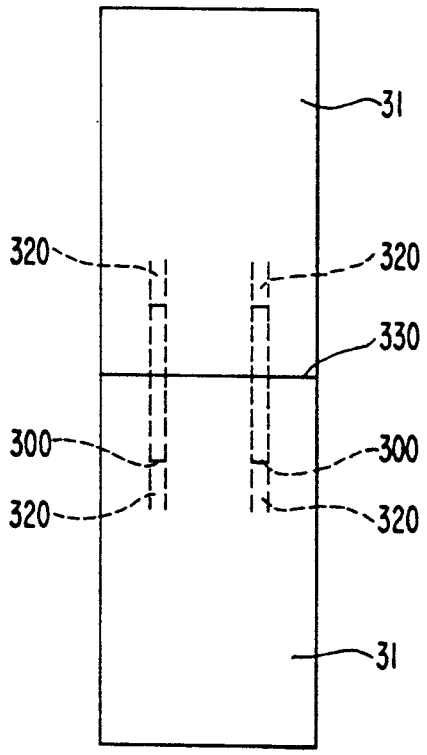
FIG. 2*a*, a top view of two adjacent rails.

The running surfaces 311 and 312 formed by railhead 31 at its free ends and the running surface 321 formed by the interior surface of lateral guide profile 32 may be worked further after installation in order to reduce waviness. The ends of adjoining railheads 31 may be provided with form-locking connecting elements 300 (see FIG. 2*a*), particularly sliding pins, which are displaceably mounted in associated longitudinal bores 320 in the end faces 330 of the adjacent railheads 31. The lateral guide profile 32 for guiding the track of the magnetic levitation vehicles by means of the horizontal rollers on its undercarriage also has a rectangular cross section, as shown in FIG. 3, and is preferably welded at a right angle to the underside of railhead 31.

Between the longitudinal track carriers 21 and the lateral guide profile 32 of the associated rail 23, a long stator 33 is fastened to the underside of the railhead 31, in particular, screwed on with the aid of angle rails 25 as shown in FIG. 3. Long stator 33 is composed of sheet metal packets which are bundled in the longitudinal direction and whose individual metal sheets are insulated while the entire sheet metal packet is coated with an elastic insulating material. The downwardly oriented face of each long stator 33 must be oriented very precisely in parallel with the upper running surface 311 of the railhead 31 so that a uniform air gap is ensured between the long stator and the non-illustrated permanent magnets of the undercarriage of the magnetic levitation vehicle which must be guided in parallel therewith.

As already mentioned, track carriers 21 are either, steel carriers or concrete carriers with steel reinforcements and steel coverings. If concrete carriers are employed, the fastening structure shown in FIG. 4 between rail 23 and concrete track carrier 21 is preferably suitable. In this case, a metal anchor plate 41 is fixed to, for example, cast into a horizontal platform (which may be a component of the box profile 24 shown in FIG. 2) of concrete track carrier 21. The free upper face of anchor plate 41 is provided with a spherical cap-shaped rounded portion and has a length, for example, of about 150 to 200 mm. The flange-shaped regions at both sides of the spherical cap-shaped rounded portion are welded to fastening pins 45 which project vertically upward. An adjustment rocker 43 is placed onto anchor plate 41 and is provided with a spherical cap-shaped recess which corresponds to the spherical cap-shaped rounded portion of the anchor plate. Rocker 43 is provided with corresponding passage bores for the passage of pins 45. Due to its spherical cap-shaped support on anchor plate 41, adjustment rocker 43 is able to tip down on both sides relative to the anchor plate 41 and track carrier 21, thus compensating for deviations from the horizontal on the part of track carrier 21. By using different thicknesses, rocker 43 further permits a height adaptation in the case of dimensional inaccuracies. The end section 46 of railhead 31 of rail 23 is placed onto adjustment rocker 43, with end section 46 passing through appropriate passage bores in pins 45. By means of an adjusting gauge, rail 23 is aligned with the oppositely disposed rail of the track profile, with this alignment possibly being effected in the longitudinal and transverse directions as well as in height and slope. Upon completion of the alignment of rail 23, rail 23 is fixed by means of fastening nuts 44 which are screwed onto the ends of fastening pins 45. The adjustment elements composed of components 41, 43, 44 and 45 are fastened to the supporting structure at longitudinal intervals and form support points for the rail 23 fastened thereto; in order to reduce noise, a damping layer may be provided between each anchor plate 41 and the associated adjustment rocker 43.

Figure 5:
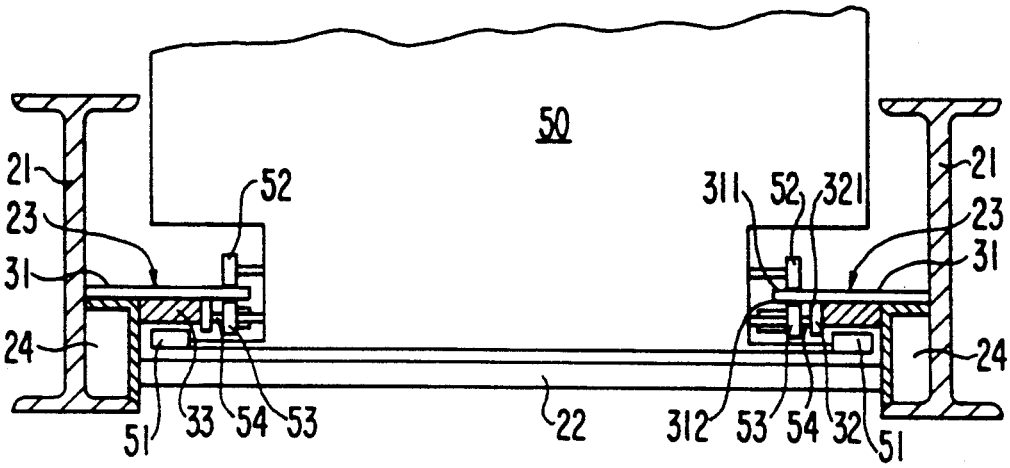
FIG. 5, a cross-sectional view of the low lying track profile of a maglev commuter train system including vehicle 50.

FIG. 5 is a cross-sectional view of the low lying track profile of a maglev commuter train system including vehicle 50. In particular, FIG. 5 shows vehicle 50 with magnets 51 and rollers 52, 53, and 54. As can be seen, railhead 31 has running surfaces 311 and 312 at its free ends and running surface 321 formed by the interior surface of lateral guide profile 32.

Figure 6:
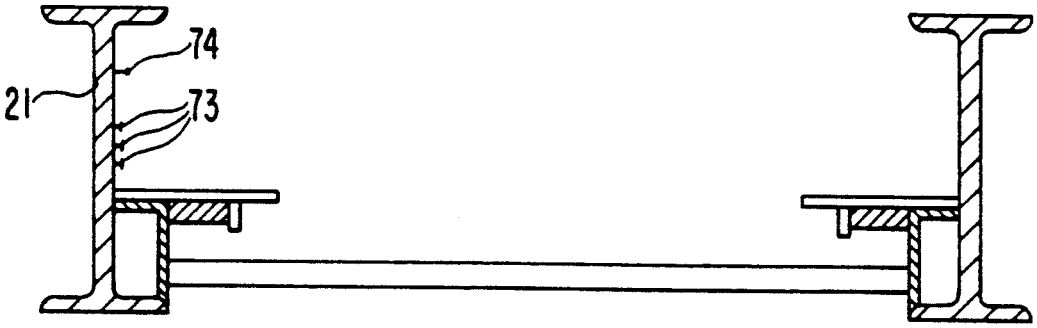
FIG. 6, a cross-sectional view of the rail with current rails 73 and line conductors 74.

FIG. 6 is a cross-sectional view of the rail with current rails 73 and line conductors 74.

The length of the track carriers 21 shown in FIG. 2 is selected so that the upper, free ends of track carriers 21 project over the rails attached thereto at approximately the illustrated ratio so that current rails 73 and/or line conductors 74 can be fastened to the vertical flanks of one of the two parallel track carriers 21 in the region above the respective rail 23 as shown in FIG. 6. The illustrated height of track carriers 21 corresponds to the given height for an elevated construction. In the case where the track carriers 21 are embedded in ballast 60 in tunnels or on bridge structures, the height of track carriers 21 can be reduced, relative to the height shown in FIG. 2, down to the fastening location of rails 23 without this worsening the strength of the track profile.

What is claimed is:

1. A rail for a magnetic levitation vehicle, comprising:

a railhead with an inner end section, a free end section, and an underside;

a long stator fastened to the underside of said railhead for generating, in cooperation with permanent magnets in the vehicle, supporting and driving forces for the vehicle; and two oppositely disposed horizontal running surfaces for pairs of spacer rollers on the vehicle; and a lateral guide profile fastened to the underside of said railhead, wherein said railhead consists of a rectangular steel plate and the free end section of said railhead presents oppositely disposed, horizontal running surfaces for pairs of spacer rollers on the vehicle and said lateral guide profile presents a vertical running surface for lateral guide rollers on the vehicle.

2. A rail according to claim 1, further comprising a track carrier, the inner end section of said railhead being fastened to said track carrier.

3. A rail according to claim 2, further comprising an adjustable screw connection between the inner end section of said railhead and said track carrier.

4. A rail according to claim 2, wherein said railhead and said long stator form a preassembled combination before said rail is fastened to said track carrier.

5. A rail according to claim 1, wherein said long stator is screwed to the underside of said railhead.

6. A rail according to claim 1, wherein said lateral guide profile is welded to the underside of said railhead.

7. A rail according to claim 1, forming a combination with an adjoining rail, said combination further comprising form-locking connection elements for connecting said rail with said adjoining rail.

8. A combination according to claim 7, wherein said form-locking connection elements comprise slide pins mounted so as to be displaceable in associated longitudinal bores in end faces of said rails.

9. A rail according to claim 1, wherein said horizontal running surfaces and said vertical running surface are smoothed when assembled in order to reduce waviness.

10. A rail according to claim 2, further comprising:

means for fastening the inner end section of said railhead to said track carrier, including a plurality of adjusting elements, disposed between said track carrier and said railhead.

11. A rail according to claim 10, wherein said plurality of adjusting elements comprises:

an anchor plate fastened to said track carrier and having a spherical cap-shaped raised portion;

an adjustment rocker disposed between said anchor plate and said railhead, said adjustment rocker including a spherical cap-shaped recess and having a thickness dimensioned to correspond to a required height compensation;

vertical threaded bolts fastened to said anchor plate so as to penetrate long hole bores in said rocker and said railhead; and securing nuts cooperating with said vertical threaded bolts for fixing a position of said railhead.

12. A rail according to claim 11, further comprising a damping layer, disposed between said anchor plate and said rocker.

13. A rail according to claim 2, wherein said track carrier comprises steel.

14. A combination including a plurality of rails each according to claim 1, and further comprising:

two track carriers extending parallel to one another, each of said two track carriers having a given height and a vertical flank for carrying a respective one of the railheads fastened as closely as possible to the lower end of the vertical flanks of the track carrier; and a transverse connector for transversely connecting said two track carriers, each of said railheads being fastened as closely as possible to a lower end of the vertical flanks and at a given minimum distance from said transverse connector.

15. A combination according to claim 14, further comprising at least one of a current rail and a line conductor fastened to the vertical flank of one of said two track carriers.

* * * * *

UNITED STATES PATENT AND TRADEMARK OFFICE

CERTIFICATE OF CORRECTION

PATENT NO. : 5,291,834

DATED : March 8, 1994

INVENTOR(S) : Hans-Rainer Quaas

It is certified that error appears in the above-indentified patent and that said Letters Patent is hereby corrected as shown below:

On title page,

Item 86: Change §§ 371 and 102(e) dates to read --May 22, 1991--.

Signed and Sealed this

Twenty-sixth Day of July, 1994

Bruce Lehman

*Attest:*

BRUCE LEHMAN

*Attesting Officer*

*Commissioner of Patents and Trademarks*